US012631170B2

(12) United States Patent
Schlosser et al.

(10) Patent No.: US 12,631,170 B2
(45) Date of Patent: May 19, 2026

(54) COMPRESSOR SYSTEM WITH A DEFORMABLE CYLINDER MAIN BODY FOR A PUNCTURE REPAIR KIT AND METHOD FOR SEALING A VEHICLE TIRE WITH SUCH A COMPRESSOR SYSTEM

(71) Applicant: Continental Reifen Deutschland GmbH, Hannover (DE)

(72) Inventors: Florian Schlosser, Barsinghausen (DE); Rainer Detering, Neustadt am Rübenberge (DE)

(73) Assignee: Continental Reifen Deutschland GmbH, Hannover (DE)

( * ) Notice: Subject to any disclaimer, the term of this patent is extended or adjusted under 35 U.S.C. 154(b) by 431 days.

(21) Appl. No.: 18/566,630

(22) PCT Filed: Dec. 2, 2021

(86) PCT No.: PCT/DE2021/200235
§ 371 (c)(1),
(2) Date: Dec. 2, 2023

(87) PCT Pub. No.: WO2022/253374
PCT Pub. Date: Dec. 8, 2022

(65) Prior Publication Data

US 2024/0262056 A1 Aug. 8, 2024

(30) Foreign Application Priority Data

Jun. 4, 2021 (DE) ..... 10 2021 205 681.4

(51) Int. Cl.
*F04B 39/12* (2006.01)
*F04B 53/16* (2006.01)

(52) U.S. Cl.
CPC ..... *F04B 39/122* (2013.01); *F04B 53/162* (2013.01)

(58) Field of Classification Search
CPC ..... F04B 53/162; F04B 2201/0808; F04B 39/122; F04B 1/0421
See application file for complete search history.

(56) References Cited

U.S. PATENT DOCUMENTS 3,502,035 A * 3/1970 Fedit ..... B05B 11/1074 92/170.1
3,954,048 A * 5/1976 Houser ..... F16J 15/44 417/269

(Continued)

FOREIGN PATENT DOCUMENTS

CN 112128079 A 12/2020
DE 102017219326 A1 5/2019

(Continued)

OTHER PUBLICATIONS

The International Search Report and the Written Opinion of the International Searching Authority mailed on Feb. 11, 2022 for the PCT Application No. PCT/DE2021/200235 which this application claims priority.

*Primary Examiner* — Nathan C Zollinger
(74) *Attorney, Agent, or Firm* — Richard A. Wolf; Gregory Adams

(57) ABSTRACT

A compressor system for a puncture repair kit, in which a supply pressure of compressed air is controlled to a specified pressure Pp or less without the use of a relief valve, having a motor, a piston, which is driven by the motor via a crank mechanism and has a cylinder component with a cylinder main body having a pump chamber, in which a piston is movable between a bottom dead center and a top dead center and air is compressed, and a receiving chamber for receiving the compressed air compressed in the pump chamber through an air discharge valve. The cylinder main body is elastically deformable as the pressure increases, the cylinder main body being deformable to such an extent that the (Continued)

compression volume V2 of the cylinder fulfills the following expression (a) $0.3 \times V1 \times P0/(PP-P0) =< V2 < 0.8 \times V1 \times P0/(PP-P0)$ (a), where V1 is a swept volume which is a cylinder volume while the piston moves from the bottom dead center to the top dead center, V2 is a compression volume which is a cylinder volume when the piston is located at the top dead center, and P0 is an air pressure.

15 Claims, 1 Drawing Sheet

(56) References Cited

U.S. PATENT DOCUMENTS

| | | | | | |
|---|---|---|---|---|---|
| 5,899,136 | A * | 5/1999 | Tarr | F02M 59/442 | 123/495 |
| 9,956,730 | B2 * | 5/2018 | Kono | F04B 35/01 | |
| 2013/0000777 | A1 * | 1/2013 | Kojima | B29C 73/166 | 141/38 |
| 2017/0356437 | A1 | 12/2017 | De Andrade | | |

FOREIGN PATENT DOCUMENTS

| | | | | |
|---|---|---|---|---|
| EP | 2918834 | B1 | 12/2017 | |
| JP | 2012101373 | A * | 5/2012 | |
| JP | 2016052739 | A * | 4/2016 | |
| WO | WO-2011055632 | A1 * | 5/2011 | B60S 5/04 |
| WO | WO-2012060296 | A1 * | 5/2012 | F04B 41/02 |
| WO | WO-2019081237 | A1 * | 5/2019 | F04B 53/008 |

* cited by examiner

COMPRESSOR SYSTEM WITH A DEFORMABLE CYLINDER MAIN BODY FOR A PUNCTURE REPAIR KIT AND METHOD FOR SEALING A VEHICLE TIRE WITH SUCH A COMPRESSOR SYSTEM

CROSS-REFERENCE TO RELATED APPLICATIONS

The present application is a National Stage Application under 35 U.S.C. § 371 of International Patent Application No. PCT/DE2021/200235 filed on Dec. 2, 2021, and claims priority from German Patent Application No. 10 2021 205 681.4 filed on Jun. 4, 2021, the disclosures of which are herein incorporated by reference in their entireties.

TECHNICAL FIELD

The invention relates to a compressor system for a puncture repair kit, to a puncture repair kit, and to a method for sealing a vehicle tire.

BACKGROUND

Compressor systems for puncture repair kits and puncture repair kits with compressors are known in the prior art and are usually used for air compression in portable devices. The use of a compressor is used to generate compressed air, by means of which a sealant for sealing a vehicle tire is pumped into the vehicle tire in the event of a puncture, and/or to fill the vehicle tire with air after sealing. The compressors usually have at least one motor and a cylinder with a reciprocating piston compressor driven via operation of a thrust crank. The cylinder is usually formed from metal so that the material is sufficiently stable to compress the air in the pump chamber by means of the reciprocating piston compressor. It is disadvantageous that the requirements for such a material severely restrict the shaping of the cylinder and thus generate high production costs. Normally, relief valves or pressure relief valves are used to limit the maximum pressure which can be generated. However, the prior art also describes other options for limiting the maximum pressure.

For example, EP2918834B1 discloses a compressor system with a motor, a piston and a cylinder without the use of a relief valve. The maximum pressure is limited by the suitable selection of the compression volume rather than by a relief valve. A disadvantage of such compressor systems is that the construction of such systems is configured only for high compression volumes.

SUMMARY

In the present invention, a compression volume which is greater than or equal to 0.8 is considered to be low. A high compression volume is considered to be in the range below 0.8, in particular in the range from 0.3 to 0.8.

It is the object of the present invention to provide a compressor system for a puncture repair kit, which allows the limitation of the maximum pressure in the range of the mean compression volume. Furthermore, it is the object of the invention to provide a puncture repair kit, which allows the limitation of the maximum pressure in the range of the mean compression volume. It is a further object of the invention to provide a method for sealing vehicle tires, by means of which vehicle tires can be sealed by the limitation of the maximum pressure in the range of the mean compression volume.

The object of the invention is achieved by a compressor system for a puncture repair kit, in which a supply pressure of compressed air is controlled to a specified pressure Pp or less without the use of a relief valve, comprising

- a motor,
- a piston, which is driven by the motor via a crank mechanism and has
- a cylinder component with a cylinder main body having a pump chamber, in which a piston is movable to and fro from a bottom dead center to a top dead center and air is compressed, and a receiving chamber for receiving the compressed air compressed in the pump chamber through an air discharge valve, where the cylinder main body is elastically deformable as the pressure increases, the cylinder main body being deformable to such an extent that the compression volume V2 of the cylinder fulfills the following expression (a)

$$0.3 \times V1 \times P0/(PP-P0) = < V2 < 0.8 \times V1 \times P0/(PP-P0), \quad \text{(a)}$$

where

- V1 is a swept volume which is a cylinder volume while the piston moves from the bottom dead center to the top dead center,
- V2 is a compression volume which is a cylinder volume when the piston is located at the top dead center, and
- P0 is an air pressure.

Advantageously, a compressor system according to the invention can be used at mean compression volumes by the use of a cylinder main body, which is elastically deformable as the pressure increases, as a result of which a significantly greater number of designs of a cylinder can be made possible and consequently production costs can be reduced. According to the invention, the maximum pressure in the cylinder can be reached despite an elastically deformable cylinder main body by the expression (a) being fulfilled. Such compressor systems can build up a sufficiently constant pressure without the use of relief valves to ensure safe use in a puncture repair kit.

According to the invention, a cylinder main body is elastically deformable as the pressure increases by the wall of the cylinder main body being able to yield as the pressure increases. It is conceivable that the side walls of the pump chamber will arch outward at elevated pressure. As the pressure decreases, the initial shape of the cylinder main body is restored. It is advantageous that such systems are optimally suited for compression volumes below 0.8. However, such a construction is not suitable for limiting the maximum pressure for compression volumes of greater than 0.8.

In a preferred embodiment of the invention, the cylinder main body comprises at least one plastic. Plastics are particularly suitable because they can be processed easily and are usually deformable. Various plastics are conceivable. Particularly preferably, at least one plastic selected from the group consisting of polyamide, polyethylene, polycarbonate and polypropylene is suitable. Such plastics have particularly suitable flexibility, which allows them to be used as a material of a cylinder component. Other common flexible plastics conventionally used for a cylinder are also suitable. It is advantageous that such plastics are elastically deformable, as a result of which such compressor systems are suitable for use without relief valves, in order to allow the limitation of the maximum pressure in the range of the high compression volume.

In a particularly preferred embodiment, the cylinder main body comprises only plastic, as a result of which the cylinder main body has particularly good elastic deformability, in order to enable the aforementioned advantages.

In another preferred embodiment, the wall of the cylinder main body comprises a thickness in the range of 1 to 3 mm. Advantageously, the wall of the cylinder main body is in the range of 1 to 3 mm, so that said wall is elastically deformable. In contrast to the requirements of a cylinder main body in the prior art, in which the latter is intended to be stable in order to reach a maximum pressure in the range of low compression volumes, an elastically deformable wall of a cylinder main body leads, according to the invention, to a limitation of the maximum pressure in the range of the mean compression volume.

In a preferred embodiment, the cylinder main body wall of the pump chamber is elastically deformable.

Furthermore preferably, the material of the cylinder wall has a bending module in the range of 0.5 to 10 GPa. It has turned out that a cylinder wall of the cylinder main body with a bending module in this range is particularly readily suitable for limiting the maximum pressure in the range of the high compression volume. In a particularly preferred embodiment, the bending module is in the range of 1 to 1.5 GPa.

In addition, the object is achieved by a puncture repair kit, wherein the puncture repair kit comprises a described compressor system and a sealant device, wherein the sealant device has a sealant for sealing a vehicle tire. Advantageously, the maximum pressure can be limited in the range of high compression volumes in a puncture repair kit. This is particularly advantageous for puncture repair kits since the design of the compressor is conventionally intended to be cost-effective and limited to the essential characteristics. A puncture repair kit according to the invention with a described compressor system enables simple production, for example of cylinder bodies made of plastics. Compressor systems without relief valves are advantageous since the risk of a return flow in the event of blockage of the air outlet is reduced.

Other advantages which have been mentioned in relation to the previous compressor system also apply, vice versa, to the puncture repair kit.

In a preferred embodiment, the compressor system is connectable to the sealant device. In the case of a puncture repair kit, a distinction is usually made between a kit with a sealant device and one without a sealant device. The sealant device in puncture repair kits with a sealant device is first of all connected to the compressor system before use. The compressor system then generates an air pressure which delivers the sealant into the vehicle tire to seal the vehicle tire.

Furthermore, the object is achieved by a method for sealing a vehicle tire using a described compressor system or a described puncture kit, comprising at least the following steps:

(i) building up a positive pressure by means of a piston in the compressor system, wherein the compression volume V2 of the cylinder fulfills the following expression (a)

$$0.3 \times V1 \times P0/(PP-P0) = < V2 < 0.8 \times V1 \times P0/(PP-P0), \quad \text{(a)}$$

where

V1 is a swept volume which is a cylinder volume while the piston moves from the bottom dead center to the top dead center, V2 is a compression volume which is a cylinder volume when the piston is located at the top dead center, and P0 is an air pressure, and ii) delivering a sealant into a vehicle tire by means of a positive pressure built up in the compressor system.

The method according to the invention for sealing a vehicle tire with a sealant is advantageous, since the limitation of the maximum pressure even for high compression volumes is possible. Even with a compressor design, in particular made of plastic, a relief valve can be dispensed with and the risk of a return flow in the event of blockage of the air outlet can be reduced.

Further advantages and features of the compressor system according to the invention and of the puncture repair kit and of the method are apparent from the dependent claims that relate to advantageous configurations of the present invention and as such should not be interpreted in a limiting manner. The invention also encompasses combinations of the features of different dependent claims where technically possible, even if the dependent claims do not relate to one another or if they belong to different claim categories. Furthermore, combinations of preferred and particularly preferred embodiments can also be combined with one another insofar as they are technically possible. This is also true of the individual features of the exemplary embodiments discussed hereinafter to the extent that a person skilled in the art is unable to recognize these as necessarily belonging together.

BRIEF DESCRIPTION OF THE DRAWINGS

Further details and advantages of the present invention will become apparent from the following description of the exemplary embodiments in conjunction with the drawings, in which.

DETAILED DESCRIPTION

Figure 1A:
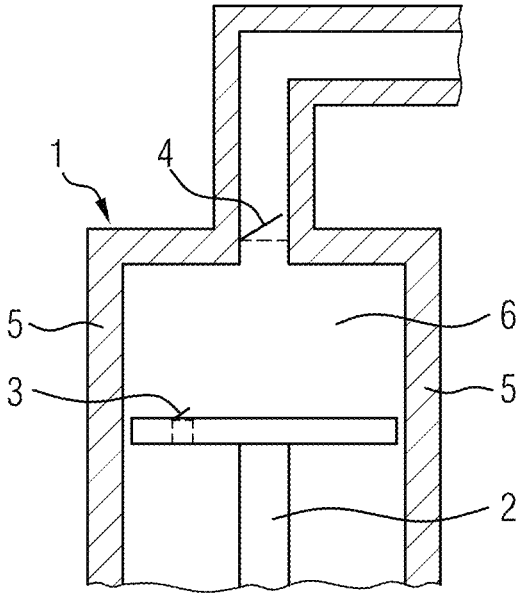
FIG. 1*a* shows a cross-sectional view of a cylinder main body with a piston at the bottom dead center.
Figure 1B:
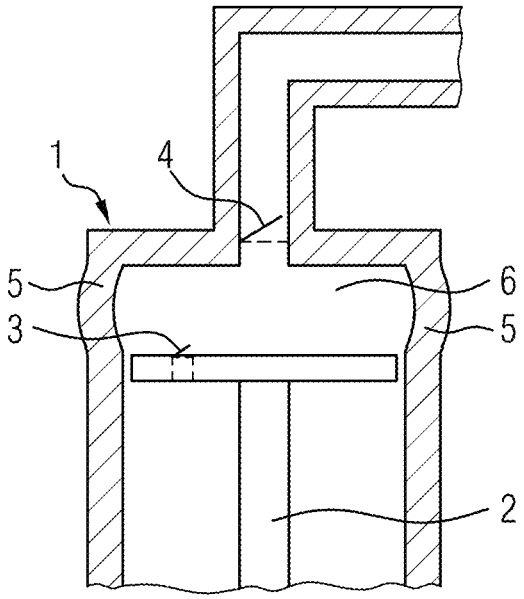
FIG. 1*b* shows a cross-sectional view of a cylinder main body with a piston at the top dead center.

FIG. 1*a* shows a cylinder main body 1 which is illustrated in a cross-sectional view with a piston 2 and an air inlet opening 3 and an air outlet opening 4, wherein such a construction is used in a compressor and/or puncture repair kit according to the invention. The two side walls 5 of the cylinder main body 1 are elastically deformable as the pressure increases. In FIG. 1*a*, the piston 2 is located at the bottom dead center, with the side walls 5 of the cylinder main body 1 not being deformed. As the pressure increases, the side walls 5 in the region of the pump chamber 6 deform outward until the piston 2 has reached the top dead center (FIG. 1*b*). The process of generating the maximum pressure and returning again to the bottom dead center of the piston 2 is reversible.

LIST OF REFERENCE SIGNS

1 Cylinder main body
2 Piston
3 Air inlet opening
4 Air outlet opening

5 Side walls

6 Pump chamber

The invention claimed is:

1. A compressor system for a puncture repair kit, in which a supply pressure of compressed air is controlled to a specified pressure PP or less without the use of a relief valve, comprising a motor, a piston, which is driven by the motor via a crank mechanism and has a cylinder component with a cylinder main body having a pump chamber, in which a piston is movable between a bottom dead center and a top dead center and air is compressed, and a receiving chamber for receiving the compressed air compressed in the pump chamber through an air discharge valve, wherein the cylinder main body is elastically deformable as pressure increases, the cylinder main body being deformable to such an extent that a compression volume V2 fulfills the following expression $$0.3 \times V1 \times P0/(PP-P0) = < V2 < 0.8 \times V1 \times P0/(PP-P0),$$

where

V1 is a swept volume which is a cylinder volume while the piston moves from the bottom dead center to the top dead center, V2 is a compression volume which is a cylinder volume when the piston is located at the top dead center, and P0 is an air pressure.

2. The compressor system as claimed in claim 1, wherein the cylinder main body comprises at least one plastic.

3. The compressor system as claimed in claim 2, wherein the wall of the cylinder main body has a thickness in the range of 1 to 3 mm.

4. The compressor system as claimed in claim 1, wherein a wall of the cylinder main body is elastically deformable.

5. The compressor system as claimed in claim 1, wherein the cylinder main body wall is formed from a material that has a bending modulus in a range from 0.5 to 10 GPa.

6. A puncture repair kit comprising the compressor system according to claim 1 and a sealant device, wherein the sealant device has a sealant for sealing a vehicle tire.

7. The puncture repair kit as claimed in claim 6, wherein the compressor system is connectable to the sealant device.

8. A method for sealing a vehicle tire using the compressor system according to claim 6, comprising at least the following steps:

(i) building up a positive pressure by means of the piston in the compressor system, and ii) delivering a sealant into a vehicle tire by means of a positive pressure built up in the compressor system.

9. The compressor system as claimed in claim 1, wherein the cylinder main body comprises polyamide.

10. The compressor system as claimed in claim 1, wherein the cylinder main body wall is formed from a material that has a bending modulus in a range from 1 to 1.5 GPa.

11. The method according to claim 8, wherein the cylinder main body comprises at least one plastic.

12. The method according to claim 8, wherein the cylinder main body comprises polyamide.

13. The method according to claim 10, wherein a wall of the cylinder main body has a thickness in the range of 1 to 3 mm.

14. The method according to claim 8, wherein the cylinder main body wall is formed from a material that has a bending modulus in a range from 0.5 to 10 GPa.

15. The method according to claim 8, wherein the cylinder main body wall is formed from a material that has a bending modulus in a range from 1 to 1.5 GPa.

* * * * *